US007797873B2

(12) United States Patent
Gering et al.

(10) Patent No.: US 7,797,873 B2
(45) Date of Patent: Sep. 21, 2010

(54) SIGHTING SYSTEM FOR A FIRE ARM

(75) Inventors: Armand Gering, Liège (BE); Tony Macaluso, Housse (BE); René Joannes, Herve (BE)

(73) Assignee: FN Herstal S.A., Herstal (BE)

( * ) Notice: Subject to any disclaimer, the term of this patent is extended or adjusted under 35 U.S.C. 154(b) by 950 days.

(21) Appl. No.: 11/515,039

(22) Filed: Sep. 5, 2006

(65) Prior Publication Data

US 2007/0056203 A1 Mar. 15, 2007

(30) Foreign Application Priority Data

Sep. 12, 2005 (BE) ..... 2005/0436

(51) Int. Cl.
*F41G 1/473* (2006.01)

(52) U.S. Cl. ..... 42/105; 42/142

(58) Field of Classification Search ..... 42/105, 42/113, 136, 142

See application file for complete search history.

(56) References Cited

U.S. PATENT DOCUMENTS 3,824,699 A * 7/1974 Lenz et al. ..... 33/334
5,026,158 A * 6/1991 Golubic ..... 356/252
5,824,942 A * 10/1998 Mladjan et al. ..... 89/41.17
7,490,430 B2 * 2/2009 Staley, III ..... 42/111

FOREIGN PATENT DOCUMENTS

EP 0 785 406 A2 7/1997

* cited by examiner

*Primary Examiner*—Stephen M Johnson
(74) *Attorney, Agent, or Firm*—Bacon & Thomas, PLLC

(57) ABSTRACT

Improved sighting system for a fire arm, characterised in that it comprises a single indicator light (6); a sighting device (7) providing an alignment opening (8) with a longitudinal reference plane (XoX') which is parallel or mainly parallel to the axis (Y-Y') of the barrel (4) and which is aligned with the indicator light (6); an inclinometer to measure the elevation angle (A) of the fire arm (1); a ballistic calculator (9) connected to the indicator light (6) and to the inclinometer, making it possible to calculate the desired angle of inclination of the fire arm (1) as a function of the distance of the target (18) and to control the indicator light (6) so as to signal at what moment the measured elevation angle (A) corresponds to the calculated elevation angle.

20 Claims, 6 Drawing Sheets

SIGHTING SYSTEM FOR A FIRE ARM

FIELD OF THE INVENTION

The invention concerns a sighting system for a fire arm designed for non-flat ballistic trajectories, such as for example a grenade launcher.

BACKGROUND

Firing with such a fire arm requires that the shooter holds the fire arm in a correct elevation angle, as a function of the distance of the target, for the projectile to effectively reach the latter during its ballistic trajectory. While doing so, the shooter must also preserve the right azimuth of alignment with regard to the target, while moving the fire arm to give it the right elevation.

Mechanical sighting systems exist, such as described in U.S. Pat. Nos. 6,568,118 and 3,604,137, which enable the shooter, as soon as he has estimated at what distance the target is situated or has obtained the exact distance by means of a range finder, to manually align the sighting element at the correct angle, given for example by an angular scale.

Such mechanical systems have two major disadvantages:

- the time to take aim is extended, as the shooter must first adjust the sighting element in a mechanical manner,
- while adjusting the range finder, the shooter loses track of the target.

More sophisticated sighting systems exist as well, as the one described in patent EP 0 785 406, which provide, in an optical window or on a video screen, the image of a reticle that moves automatically as a function of the measured distance, whereby the shooter must align said image with the target.

Such solutions including systems with what are called a "moving red point" in which the image of the reticle is projected to infinity at the correct angle, so as to eliminate the parallax error, are disadvantageous in that they are too heavy and too sizeable to be used for example on an assault gun.

SUMMARY

The invention concerns a device which is easy to use, light and compact, which automatically indicates the correct elevation to the shooter, while enabling him to maintain the sighting azimuth.

To this end, the invention concerns an improved sighting system which comprises a single indicator light; a sighting device providing an alignment opening with a longitudinal reference plane which is parallel or mainly parallel to the axis of the gun, and which is aligned with the indicator light; an inclinometer to measure the elevation angle of the fire arm; a ballistic calculator connected to the indicator light and to the inclinometer, making it possible to calculate the desired angle of inclination of the fire arm as a function of the distance of the target and to control the indicator light so as to signal at what moment the measured elevation angle corresponds to the calculated elevation angle.

Such a sighting system enables the shooter to instinctively and simultaneously obtain the correct elevation and azimuth when firing, even at night.

The shooter only has to position his fire arm so as to align the indicator light with the target through the opening and then, while staying aligned with the target, to lift the barrel of his gun so as to look for the correct calculated elevation through the ballistic calculator while observing the signal of the indicator light.

The ballistic calculator calculates the required elevation angle as a function of the distance of the target, whereby the calculator receives this information either from the shooter who estimates the distance, or via a range finder connected to the calculator, which measures the distance.

In order to limit the size of the sighting system, the length of the sighting device and of the indicator light as a whole amounts to 10 cm or less.

The sighting device may be collapsible in order to gain even more place when the fire arm is not in use and so as to better protect the device.

A special characteristic of the sighting device is that it does not necessarily have to be close to the eye of the shooter, what guarantees the latter a good view of the field and of the target and gives him much freedom of movement in his firing position.

To that end, the sighting system is preferably mounted at a distance from the eye of the shooter when the latter is in a firing position, so as to facilitate the adaptation of the shooter's eye to the light signal.

Another special characteristic of the sighting device is that the alignment opening of the indicator light provided by the sighting device, thanks to its position, provides a vertical point of reference to the shooter, as a result of which he does not have to laterally incline his fire arm, which might deform the trajectory of the projectile, also known by the term "cant" error.

In a special embodiment, a second inclinometer is added which is connected to the ballistic calculator and which measures, while aiming, the remaining lateral inclination of the longitudinal reference plane of the sighting device and thus of the fire arm in relation to the horizontal line, and at right angles to the axis of the barrel, whereby said measured "cant" error is used by the ballistic calculator to consequently correct the elevation angle.

In the case of the special embodiment which integrates a range finder in the sighting system, the ballistic calculator registers the initial elevation angle of the fire arm at the time of the range finding, such that when calculating the trajectory, the inclined position of the target in relation to the shooter is taken into account.

In another case of a special embodiment, the ballistic calculator is connected to the firing mechanism of the fire arm, for example by means of a solenoid, so that the firing is started as soon as the fire arm has reached the right firing position calculated by the ballistic calculator.

This makes it possible to reduce the time to take aim and to fire with more precision, as the shooter only uses the sighting system to preserve the azimuth and to control the elevation movement of the fire arm, as the exact moment at which the correct elevation is reached is automatically transmitted to the fire arm, without requiring any other specific action of the shooter.

In the latter special case, the connection of the ballistic calculator to the firing mechanism of the fire arm is preferably interrupted when the trigger of the fire arm is not activated, so as to prevent any accidental or untimely firing.

In the case of automatic firing, activated by the ballistic calculator, the indicator light might be omitted.

BRIEF DESCRIPTION OF THE DRAWINGS

For clarity's sake, a few examples of embodiments of an improved sighting system according to the invention are given as an example only without being limitative in any way, with reference to the accompanying drawings, in which.

DETAILED DESCRIPTION OF THE DRAWINGS

Figure 1:
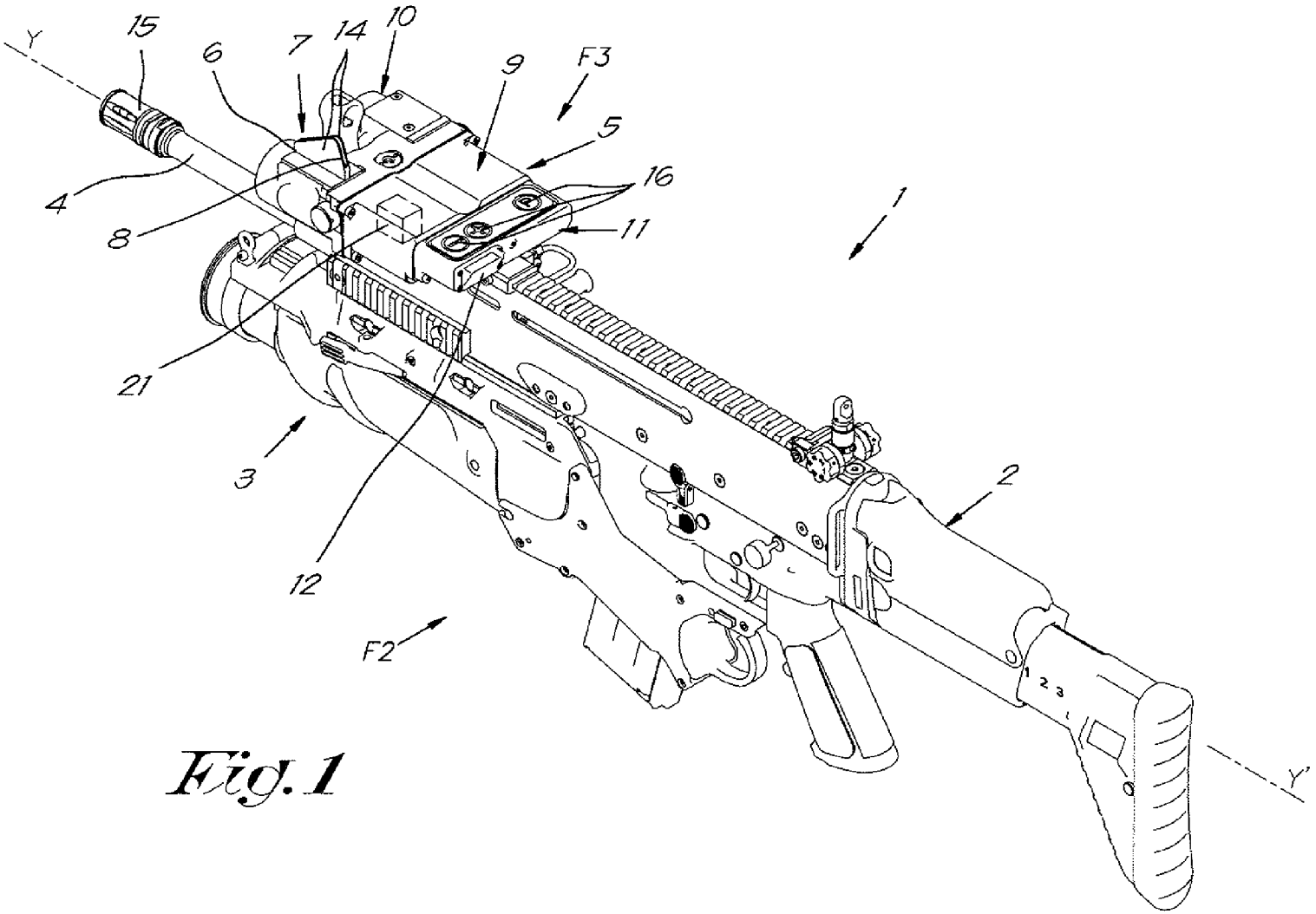
FIG. 1 is a view in perspective of a fire arm equipped with a sighting system according to the invention.
Figure 2:
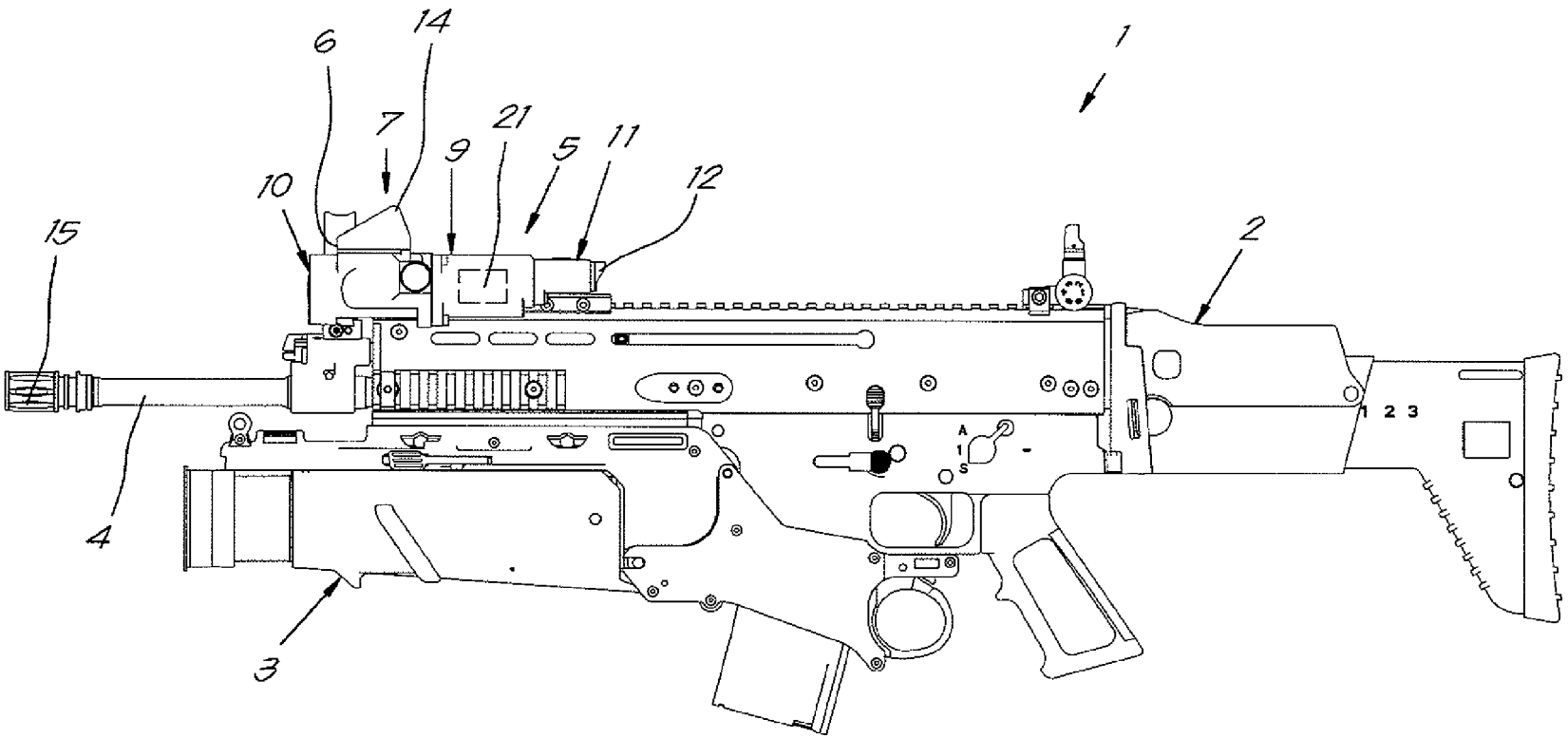
FIG. 2 represents a lateral view according to arrow F2 in FIG. 1.

FIGS. 1 and 2 represent a fire arm 1 composed of a gun 2 and a grenade launcher 3 mounted under the barrel 4 of the gun 2 and provided with a sighting system 5 according to the invention mounted on the fire arm 1.

Figure 3:
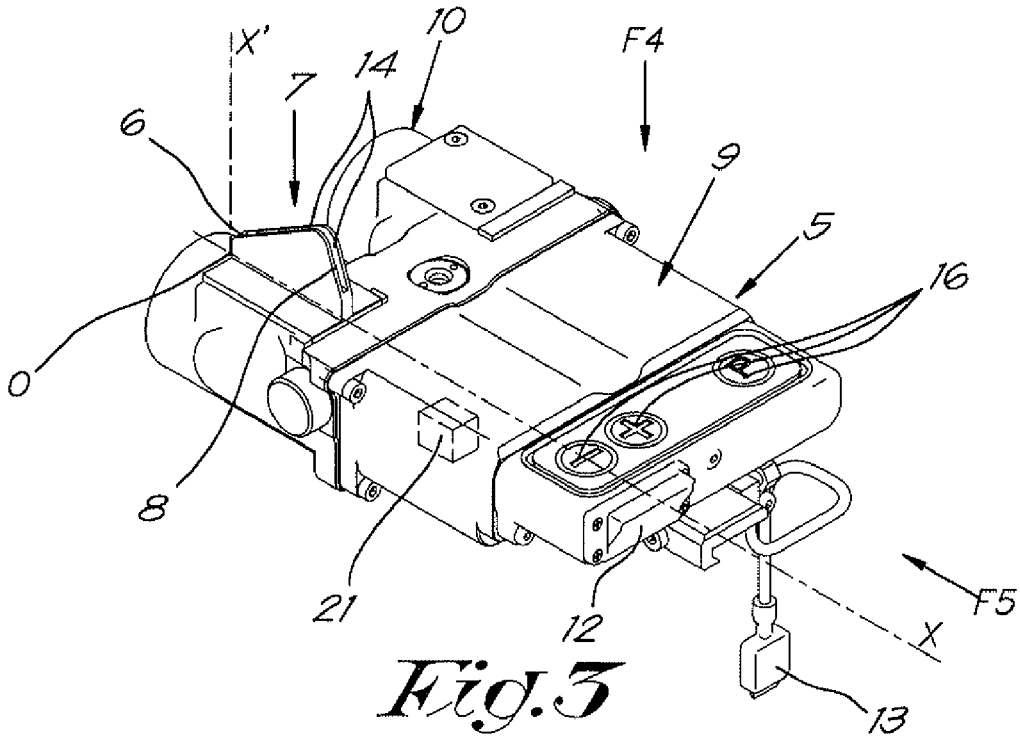
FIG. 3 represents the sighting system indicated by the arrow F3 in FIG. 1 to a larger scale.
Figure 4:
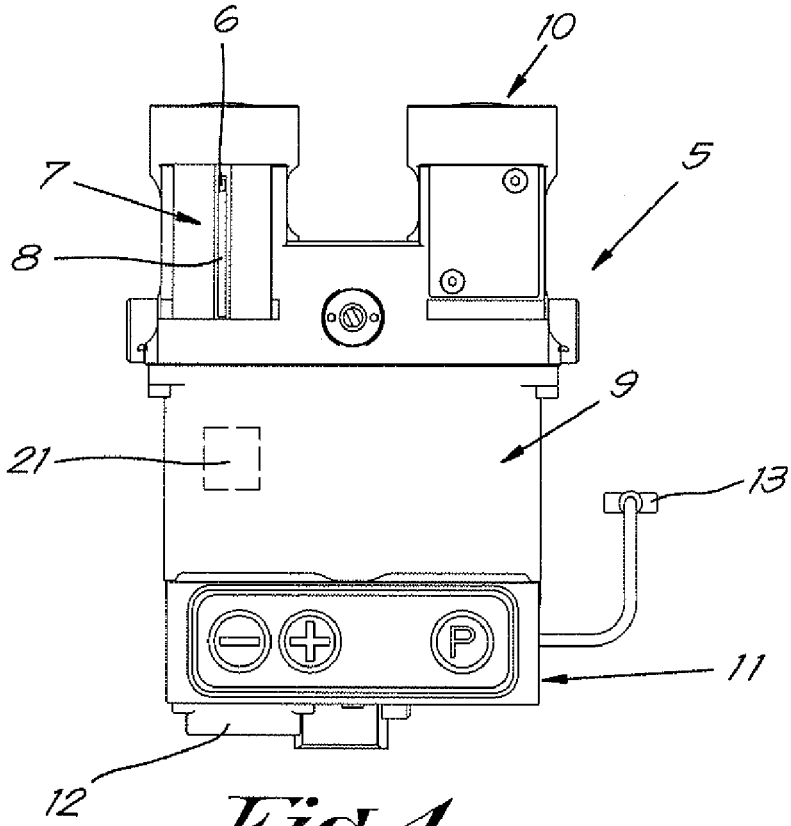
FIGS. 4 and 5 are respective views according to arrows F4 and F5 in FIG. 3.
Figure 5:
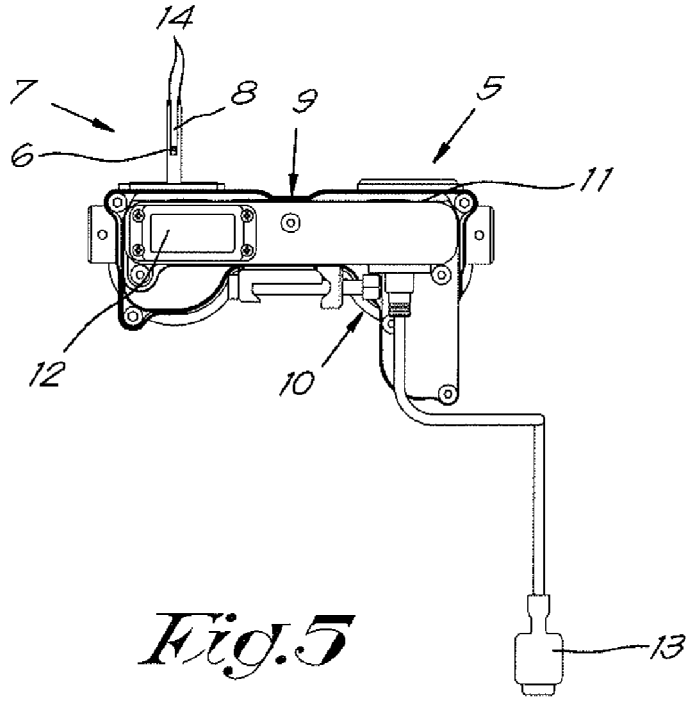

The sighting element 5 is represented in greater detail in FIGS. 3 to 5 and mainly comprises an indicator light 6; a sighting device 7 providing a vertical alignment opening 8 in relation to a longitudinal reference plane XoX' which is parallel or mainly parallel to the axis Y-Y' of the barrel 4 and which is aligned with the indicator light 6; an inclinometer 21 which is used to measure the elevation angle A of the fire arm and a ballistic calculator 9 connected to the indicator light 6 and to the inclinometer 21.

The ballistic calculator 9 is equipped with a range finder 10 which is connected to the ballistic calculator 9 in order to measure the distance of the target.

The ballistic calculator 9 is further provided with an interface 11 enabling the shooter to input data, such as for example the type of the fire arm being used, and with a screen 12 to display certain data such as for example the measured distance.

A switch 13 makes it possible to activate the range finder at any given time while aiming.

In the given case, the sighting device 7 is formed of two walls that are parallel or mainly parallel to the axis Y-Y' of the barrel 4 of the fire arm 1, whereby the height of the walls 14 decreases towards the front far end 15 of the fire arm 1.

In the present case, the indicator light 6 consists of a light spot, for example in the form of a LED which is situated between two walls 14 and which, as a function of the received signal, may change colour, for example from red to green.

The ballistic calculator 9 makes it possible to calculate the desired angle of inclination of the fire arm as a function of the distance of the target measured by the range finder 10 and to control the signal of the indicator light 6 so as to signal the moment at which the measured elevation or inclination angle A corresponds to the calculated elevation angle.

The ballistic calculator 9 controls the indicator 6, for example such that the indicator 6 transmits a light signal with a certain colour, preferably red, as long as the measured inclination angle A does not correspond to the calculated inclination angle, and changes colour, preferably to green, as soon as the measured inclination angle A corresponds to the calculated angle.

In order to indicate to the shooter that he is aiming too high or too low, the indicator signal may be conceived such that it will blink as long as the measured elevation angle A is inferior to the calculated angle, whereas the signal will be a continuous signal as soon as the measured angle A reaches the calculated value or exceeds said calculated value.

In order to indicate to the shooter that he is approaching the required elevation angle or deviating from it, the light signal may start blinking faster and faster when the measured angle of the fire arm A comes closer to the calculated value.

Figure 6:
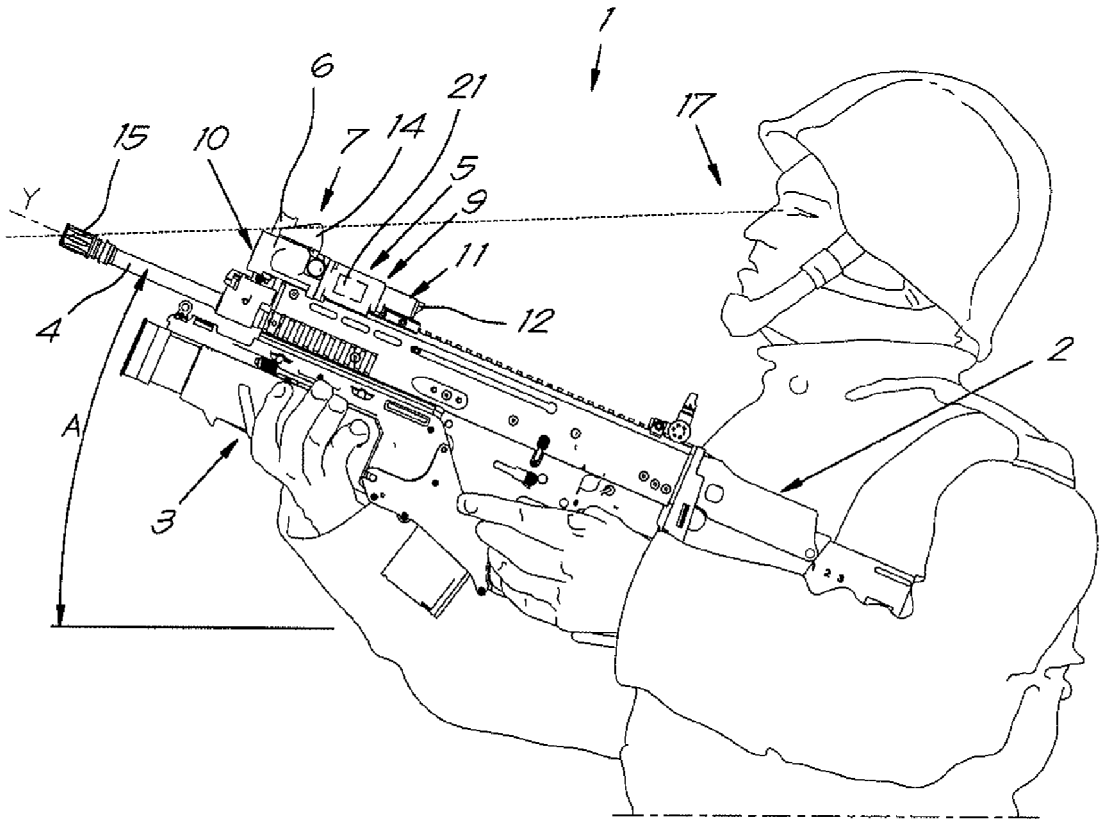
FIG. 6 represents a shooter using the fire arm of FIG. 1 while aiming at a target.
Figure 7:
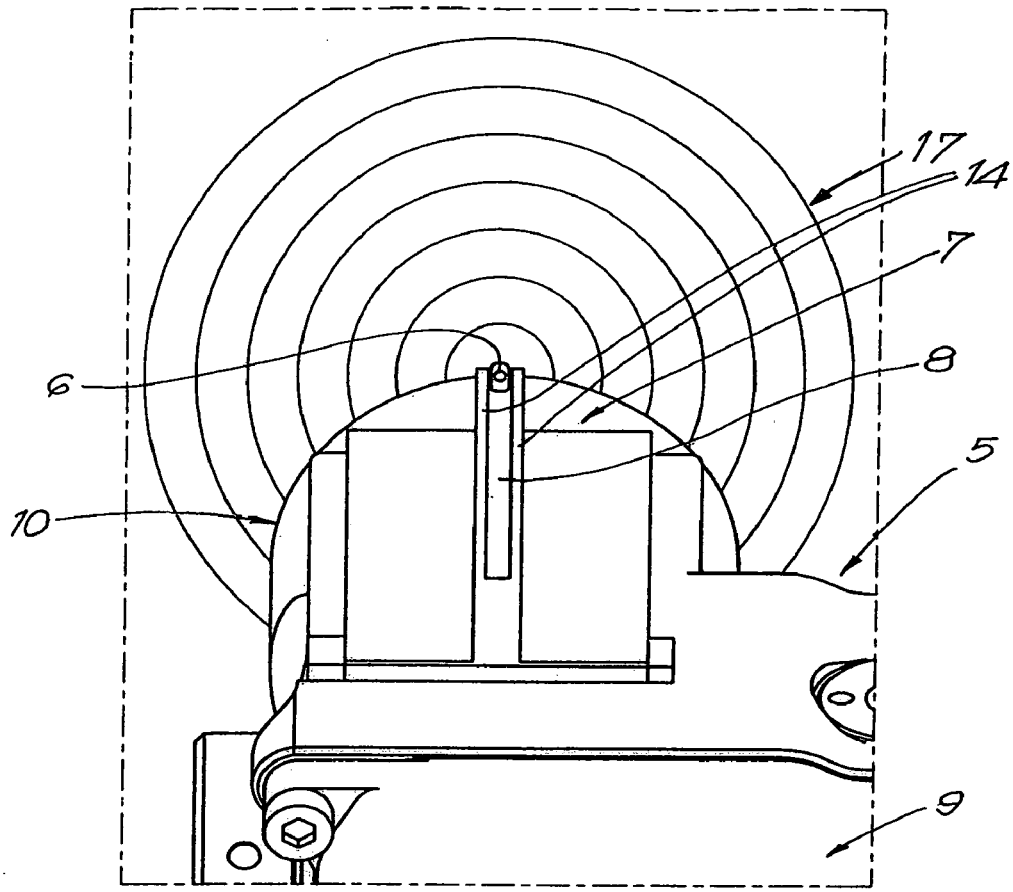
FIG. 7 is what the shooter in the position in FIG. 6 sees.

The use of the sighting system is simple and is explained hereafter starting from FIGS. 6 and 7.

The shooter 15 may first have to enter in the ballistic calculator 9, for example by means of the control buttons 16 of the interface 11 and of the screen 12, what type of grenade he is using, whereby the calculator is able to memorize the ballistic characteristics of several ammunitions.

Next, the shooter 17 determines at what distance the target 18 is situated by aiming at the target 18 with the help of the sighting elements of the fire arm and by activating the range finder by means of the switch 13 so as to register this distance in the ballistic calculator 9, which will immediately calculate the ballistic trajectory of the chosen ammunition, and in particular the inclination angle of the fire arm 1 required to hit the target.

Then, the shooter 17 puts himself in line with the target 18 as illustrated in FIG. 6, aims at the target 18 as represented in FIG. 7 and pivots his fire arm 1 as indicated in FIG. 6 while observing the signal of the indicator light 6.

The indicator light 6 will indicate to the shooter 17 that he is aiming too low by emitting a red blinking signal.

The signal starts blinking faster and faster when the angle calculated by the ballistic calculator 9 is approached, and it becomes a continuous green signal as soon as the calculated angle is reached, so as to signal to the shooter that he has to pull the trigger of the fire arm 1 in order to fire. The signal becomes a continuous red signal as soon as the shooter exceeds the correct aiming angle, i.e. aims too high.

It is clear that the signal of the ballistic calculator 9 may also be used to control the automatic release of the firing mechanism of the fire arm as soon as the right firing angle has been reached.

In practice, the fire arm 1 can be manipulated rather easily and intuitively.

It is clear that, in a simpler embodiment, the range finder 10 can be omitted. The distance of the target 18 will then be determined in another manner, for example by an estimation made by the shooter 17, who can register the estimated distance by means of the interface 11.

It is also clear that the sighting system 5 can be realised as a unit that can be dismounted from the fire arm 1 or that can be incorporated in the fire arm 1.

Figure 8:
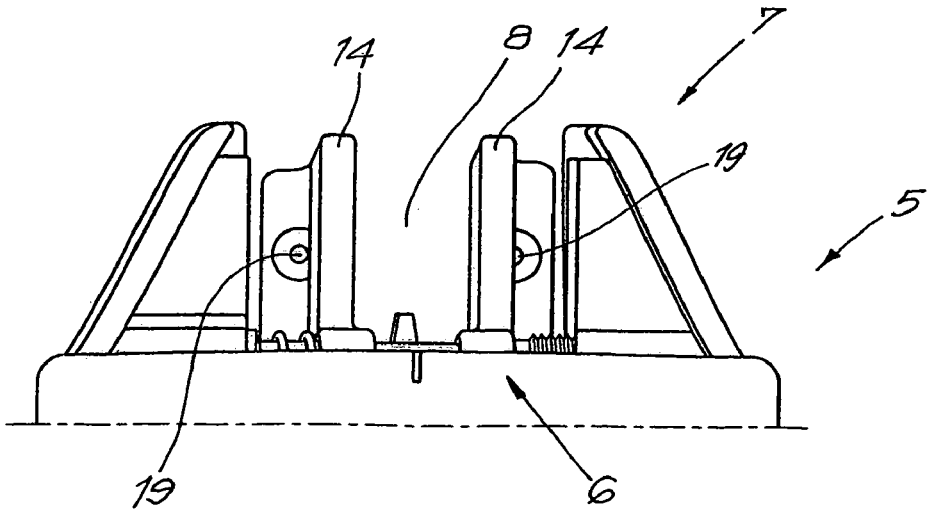
FIG. 8 is a view similar to that of FIG. 1, but for a variant of a sighting system according to the invention.

FIG. 8 shows a sighting device 1 with two walls 14 as well to provide an alignment opening 8, but whereby the indicator light 6 consists of two light spots 19 situated on either side of the sighting device 7 and immediately next to the walls 14.

The use of this device is similar to that of the preceding case.

Figure 9:
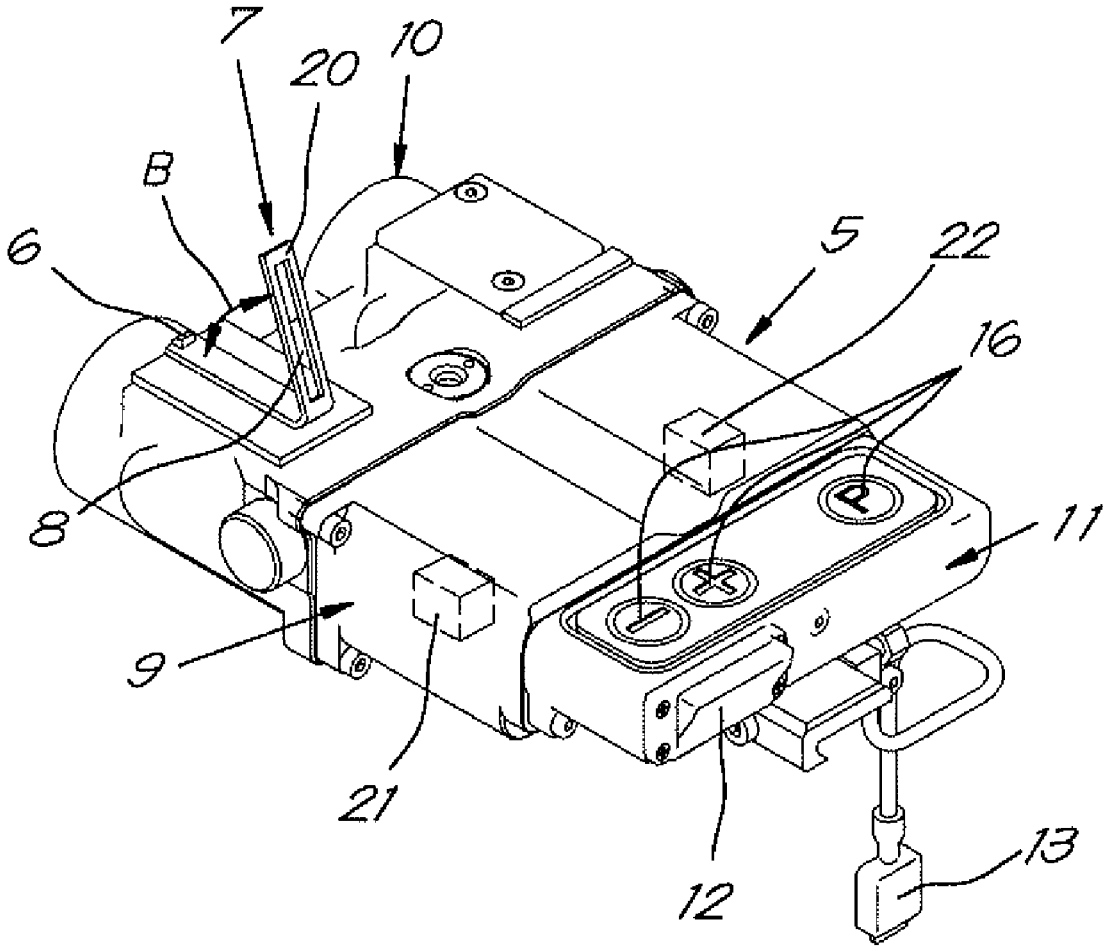
FIG. 9 is another variant of a sighting system according to FIG. 3.

FIG. 9 shows a variant of a sighting system 5 according to the invention which is similar to that FIG. 3, but in which the sighting device 7 is formed of a rectangular frame 20 which is raised, forming an angle B with the axis Y-Y' of the barrel 4 of the fire arm 1 and providing an opening 3. Also shown is a second inclinometer 22 which is connected to the ballistic calculator 9 and which measures, while aiming, the remaining lateral inclination of the longitudinal reference plane of the sighting device and thus of the fire arm in relation to the horizontal line, and at right angles to the axis of the barrel, whereby said measured "cant" error is used by the ballistic calculator to consequently correct the elevation angle.

It is clear that the rectangular frame 20 can be replaced by a U-shaped or V-shaped frame or any other device defining a vertical opening.

It is also clear that the sighting device 7 can be realised in a hinging manner, for example by providing a joint at the bottom of the frame 20.

It is clear that the invention is by no means limited to the examples described above, but that many modifications can be made to the above-described sighting system while still remaining within the scope of the invention as defined in the following claims.

The invention claimed is:

1. Sighting system for a fire arm having a barrel, comprising a single indicator light (6); a sighting device (7) providing an alignment opening (8) with a longitudinal reference plane (XoX') which is parallel or mainly parallel to the axis (Y-Y') of the barrel (4), and which is aligned with the indicator light (6); an inclinometer for obtaining a measured elevation angle (A) of the fire arm (1); a ballistic calculator (9) connected to the indicator light (6) and to the inclinometer, arranged for calculation of a calculated elevation angle of the fire arm (1) as a function of the distance of the target (18) and to control the indicator light (6) so as to signal at what moment the measured elevation angle (A) corresponds to the calculated elevation angle.

2. Sighting system according to claim 1, including a range finder (10) connected to the ballistic calculator (9) and arranged to measure the distance of the target (18).

3. Sighting system according to claim 2, wherein the ballistic calculator (7) is arranged to register the initial elevation angle of the fire arm (1) at the time of the range finding, such that when calculating the calculated elevation angle, the inclined position of the target (18) in relation to the shooter (17) is taken into account.

4. Sighting system according to claim 1, wherein the indicator light (6) comprises at least one light spot which emits a light signal with a colour, as long as the measured elevation angle (A) does not correspond to the calculated elevation angle, and which emits a different colour, as soon as the measured elevation angle (A) corresponds to the calculated elevation angle.

5. Sighting system according to claim 4, wherein the indicator light (6) comprises a single light spot in line with the longitudinal reference plane (XoX') of the alignment opening (8).

6. Sighting system according to claim 4, wherein the indicator light (6) comprises two light spots (19), laterally spaced on either side of the sighting device (7).

7. Sighting system according to claim 1, wherein the signal of the indicator light (6) is a signal that blinks as long as the measured elevation angle (A) is inferior to the calculated elevation angle, whereas the signal is a continuous signal as soon as the measured elevation angle (A) reaches the calculated elevation angle or exceeds said calculated elevation angle value.

8. Sighting system according to claim 7, wherein the blinking becomes faster and faster as soon as the measured elevation angle (A) approaches the calculated elevation angle.

9. Sighting system according to claim 1, wherein the sighting device (7) provides a vertical alignment opening (8).

10. Sighting system according to claim 9, wherein the sighting device (7) comprises two walls (14) that are parallel or mainly parallel to the axis (Y-Y') of the barrel (4) of the fire arm (1).

11. Sighting system according to claim 10, wherein the height of the walls (14) diminishes towards a front far end (15) of the fire arm (1).

12. Sighting system according to claim 10, wherein the indicator light (6) is situated between the two walls (14).

13. Sighting system according to claim 9, wherein the sighting device (7) is formed of a raised frame (20) forming an angle (B) with the axis (Y-Y') of the barrel (4) of the fire arm (1).

14. Sighting system according to claim 1, wherein the sighting device (7) is hinged.

15. Sighting system according to claim 1, wherein the sighting device and indicator light are mounted on the fire arm at a distance from the eye of the shooter (17) when the latter is in a firing position.

16. Sighting system according to claim 1, wherein the length in the longitudinal sense of the fire arm (1) of the sighting device (7) and the light indicator (6) as a whole amounts to 10 cm or less.

17. Sighting system according to claim 1, including a second inclinometer connected to the ballistic calculator (9) arranged to measure the lateral inclination of the longitudinal reference plane of the sighting device (7) in relation to the horizontal, and wherein the ballistic calculator (9) is arranged to calculate the correction of the elevation angle of the arm (1) as a function of said measured lateral inclination angle.

18. Sighting system according to claim 1, wherein the ballistic calculator (9) is connected to the firing mechanism of the fire arm (1) so as to start firing as soon as the fire arm (1) has reached the right firing position calculated by the ballistic calculator (9).

19. Sighting system according to claim 18, wherein the connection of the ballistic calculator (9) to the firing mechanism of the fire arm (1) is interrupted when the trigger of the fire arm (1) is not activated.

20. Sighting system according to claim 1, wherein the sighting system is arranged so that the sighting system can be dismounted from the fire arm (1).

* * * * *